US007911303B2

(12) United States Patent
Morita et al.

(10) Patent No.: US 7,911,303 B2
(45) Date of Patent: Mar. 22, 2011

(54) CIRCUIT BREAKER AND OPENING AND CLOSING METHOD THEREOF

(75) Inventors: Ayumu Morita, Hitachi (JP); Minoru Hosoda, Hitachinaka (JP); Yoshihiko Matsuda, Hitachiota (JP); Masato Suzuki, Hitachi (JP); Keiichi Miyashita, Hitachi (JP); Shigetoshi Oouchi, Hitachi (JP); Masaaki Saitou, Hitachi (JP); Akihito Yano, Hitachiota (JP)

(73) Assignee: Hitachi, Ltd., Tokyo (JP)

( * ) Notice: Subject to any disclaimer, the term of this patent is extended or adjusted under 35 U.S.C. 154(b) by 511 days.

(21) Appl. No.: 11/961,607

(22) Filed: Dec. 20, 2007

(65) Prior Publication Data

US 2008/0156775 A1 Jul. 3, 2008

(30) Foreign Application Priority Data

Dec. 28, 2006 (JP) ..... 2006-353644

(51) Int. Cl.

| | |
|---|---|
| ***H01H 9/00*** | (2006.01) |
| ***H01H 75/00*** | (2006.01) |
| ***H01H 77/06*** | (2006.01) |
| ***H01H 51/00*** | (2006.01) |
| ***H01H 3/00*** | (2006.01) |
| ***H01H 33/66*** | (2006.01) |
| ***H01H 33/02*** | (2006.01) |
| ***H01F 7/08*** | (2006.01) |

(52) U.S. Cl. ..... 335/174; 335/13; 335/38; 335/151; 335/153; 335/154; 335/179; 335/192; 335/195; 335/220; 335/229; 335/241; 335/299; 218/120; 218/140; 218/141; 218/154

(58) Field of Classification Search ..... 335/13, 335/38, 68, 77, 90, 91, 95, 115, 118, 131, 335/151, 153, 154, 161, 170, 174, 179, 180, 335/189, 192, 194, 195, 220, 229, 234, 238, 335/241, 246, 250, 251, 253, 254, 266, 271, 335/281, 297, 299; 218/120, 140, 141, 153, 218/154

See application file for complete search history.

(56) References Cited

U.S. PATENT DOCUMENTS

| | | | | |
|---|---|---|---|---|
| 3,503,022 | A | 3/1970 | Burdett | |
| 4,859,975 | A * | 8/1989 | Uetsuhara | 335/230 |
| 5,252,933 | A * | 10/1993 | Kamino et al. | 335/172 |
| 5,912,604 | A * | 6/1999 | Harvey et al. | 335/9 |
| 6,020,567 | A * | 2/2000 | Ishikawa et al. | 218/154 |

(Continued)

FOREIGN PATENT DOCUMENTS

EP 1102295 A2 * 5/2001

(Continued)

*Primary Examiner* — Lincoln Donovan
*Assistant Examiner* — Mohamad A Musleh
(74) *Attorney, Agent, or Firm* — Mattingly & Malur, PC.

(57) ABSTRACT

A circuit breaker includes a vacuum valve, an electromagnet including a first coil for driving an operating shaft of the vacuum valve toward an opening direction by electromagnetic repulsion, a movable core and a permanent magnet. Further, an operating mechanism is provided which excites the first coil to close the vacuum valve, holds the vacuum valve closed by an attractive force of the permanent magnet and excites the first coil in a direction reverse to an excitation direction in closing operation to open the vacuum valve. In the circuit breaker, together with the first coil, a second coil is disposed which is excited simultaneously with an electromagnetic repulsion coil for a quick opening operation by electromagnetic repulsion is provided in the electromagnet.

10 Claims, 8 Drawing Sheets

U.S. PATENT DOCUMENTS

| | | | | |
|---|---|---|---|---|
| 6,153,846 | A * | 11/2000 | Morita et al. | 218/122 |
| 6,262,648 | B1 * | 7/2001 | Lammers | 335/229 |
| 6,373,675 | B1 * | 4/2002 | Yamazaki et al. | 361/135 |
| 2001/0017288 | A1 * | 8/2001 | Morita et al. | 218/154 |
| 2002/0093408 | A1 * | 7/2002 | Morita et al. | 335/220 |
| 2006/0028073 | A1 * | 2/2006 | Sugino et al. | 310/49 R |
| 2006/0037944 | A1 * | 2/2006 | Morita et al. | 218/140 |
| 2006/0130785 | A1 * | 6/2006 | Han et al. | 123/90.11 |
| 2007/0007249 | A1 * | 1/2007 | Kikuchi et al. | 218/128 |

FOREIGN PATENT DOCUMENTS

| | | |
|---|---|---|
| EP | 1416503 | 5/2004 |
| JP | 56-46919 U | 4/1981 |
| JP | 2000-299041 | 10/2000 |

* cited by examiner

OPERATION OF SWITCHES IN CASE OF AN ACCIDENT

OPERATION OF SWITCHES IN NORMAL OPERATION

CIRCUIT BREAKER AND OPENING AND CLOSING METHOD THEREOF

CLAIM OF PRIORITY

The present application claims priority from Japanese application serial No. 2006-353644, filed on Dec. 28, 2006, the content of which is hereby incorporated by reference into this application.

FIELD OF THE INVENTION

The present invention relates to a circuit breaker and more particularly to a circuit breaker provided with an opening means which quickly drives an operating shaft of a vacuum valve toward an opening direction by electromagnetic repulsion, and an opening and closing method thereof.

BACKGROUND OF THE INVENTION

An opening means which quickly drives an operating shaft of a vacuum valve toward an opening direction by electromagnetic repulsion comprises an electromagnetic repulsion coil and a ring copper plate located opposite to it where the vacuum valve is opened by quickly exciting the electromagnetic repulsion coil of the opening means by a capacitor discharge or the like and using an electromagnetic repulsive force such as eddy current which occurs in the coil current and copper plate.

Circuit breakers with an electromagnetic repulsion mechanism are classified into direct-current circuit breakers and high-speed circuit breakers. In the former type, charge in a previously charged capacitor is injected in a direction reverse to the direction of line current to make a zero current point forcedly to interrupt the current. If an accidental short circuit occurs in the DC line, an overcurrent as determined by resistance and inductance as circuit constants, like fast-rising short-circuit current, flows, necessitating the breaker to operate quickly.

On the other hand, a high speed breaker is used in a private power generation system or the like and introduced in order to prevent electrical leakage from the private power generation equipment in a power failure, to prevent power supply systems from going down due to an overload, or assure continuous operation of a critical load by quickly switching from a defective power system to a normal one. This type of breaker also uses an electromagnetic repulsion mechanism because a response of the breaker must be within several milliseconds after receipt of an opening command.

One known example of such a breaker with an electromagnetic repulsion driving mechanism is the one disclosed in JP-A No. 2000-299041 which includes a vacuum valve, an operating mechanism provided in the opening and closing of the vacuum valve, and an electromagnetic repulsion driving mechanism provided midway in the operating mechanism and further includes a mechanism for reducing rebound of the movable electrode shaft in the course of current interruption.

SUMMARY OF THE INVENTION

However, the above conventional circuit breakers are compelled to provide a large electromagnetic repulsion driving mechanism and a larger power supply capacity because they not only have to obtain a prescribed opening speed but also require an electromagnetic repulsive force exceeding the attractive force of a permanent magnet for holding the closed state. Besides, since the electromagnetic repulsion driving mechanism and the mechanism for reducing rebound of the movable electrode shaft during action of the electromagnetic repulsion driving mechanism are vertically disposed in series between the vacuum valve and its operating mechanism, the electromagnetic repulsion driving mechanism and the mechanism for reducing rebound of the movable electrode shaft must be both moved when the vacuum valve is opened or closed.

Therefore, if the vacuum valve operating mechanism is of the electromagnetically driven type, its components such as the permanent magnet and exciting coil must have a large capacity, which means that the vacuum valve operating mechanism should be large enough. In addition, the vacuum valve operating mechanism can become less maneuverable due to its size.

The present invention has been made in view of the above circumstances and an object thereof is to provide a circuit breaker which enables an electromagnetic repulsion driving mechanism to easily cancel the closed state and reduces the rebound of a movable electrode shaft in the course of current interruption in a simple manner and provides high maneuverability, and an opening and closing method thereof.

In order to achieve the above objects, a circuit breaker according to the present invention that comprises a first coil in an electromagnet which opens and closes a vacuum valve, a second coil provided in the electromagnet together with the first coil, and an electromagnetic repulsion coil connected in series with the second coil, wherein the second coil and the electromagnetic repulsion coil are excited simultaneously in quick opening operation by electromagnetic repulsion. In another aspect of the present invention, the circuit breaker comprises a vacuum valve, an electromagnet including a coil for driving an operating shaft of the vacuum valve toward an opening direction by electromagnetic repulsion, a movable core and a permanent magnet, and an operating mechanism which excites the coil to close the vacuum valve, holds the vacuum valve closed by an attractive force of the permanent magnet and excites the coil in a direction reverse to an excitation direction in closing operation to open the vacuum valve, wherein, together with the coil, a second coil which is excited simultaneously with an electromagnetic repulsion coil for electromagnetic repulsion in quick opening operation by electromagnetic repulsion is provided in the electromagnet.

DETAILED DESCRIPTION OF THE PREFERRED EMBODIMENTS

According to an embodiment of the present invention, a circuit breaker opening and closing method wherein a vacuum valve is opened or closed by excitation of a first coil, and a second coil provided in an electromagnet together with the first coil and an electromagnetic repulsion coil connected serially are simultaneously excited in quick opening operation by electromagnetic repulsion. The circuit breaker opening and closing method in which a coil of an electromagnet for driving an operating shaft of a vacuum valve toward an opening direction by electromagnetic repulsion is excited to close the vacuum valve, the vacuum valve is held closed by an attractive force of a permanent magnet of the electromagnet and the coil is excited in a direction reverse to an excitation direction in closing operation to open the vacuum valve is characterized in that a second coil provided in the electromagnet together with the coil and an electromagnetic repulsion coil for electromagnetic repulsion are simultaneously excited in quick opening operation by electromagnetic repulsion.

According to another embodiment of the present invention, an electromagnet coil is excited in a direction reverse to an excitation direction in closing operation simultaneously with opening operation by an electromagnetic repulsion driving mechanism, so that the attractive force of a permanent magnet to hold the closed state decreases and cancellation of the closed state becomes easy and rebound of a movable electrode shaft in the course of current interruption can be reduced in a simple manner and a highly maneuverable circuit breaker and an opening and closing method thereof can be obtained.

The object of providing a circuit breaker which enables an electromagnetic repulsion driving mechanism to easily cancel the closed state and reduces rebound of a movable electrode shaft in the course of current interruption in a simple manner and provides high maneuverability as well as an opening and closing method thereof is achieved in a simple manner.

Next, embodiments of a circuit breaker according to the present invention will be described.

Figure 1:
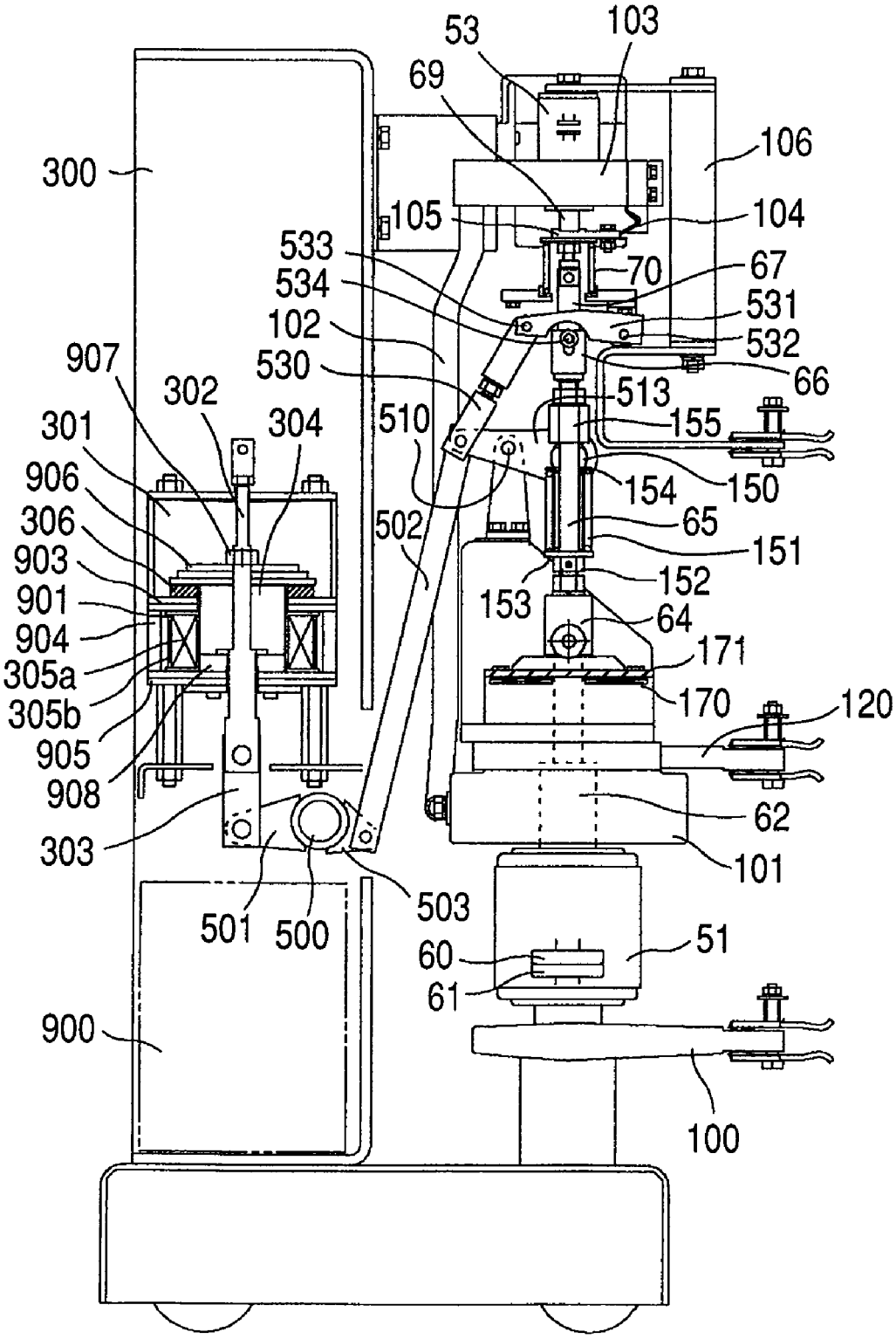
FIG. 1 is a left side view of a commutation type DC circuit breaker according to an embodiment of the present invention.
Figure 2:
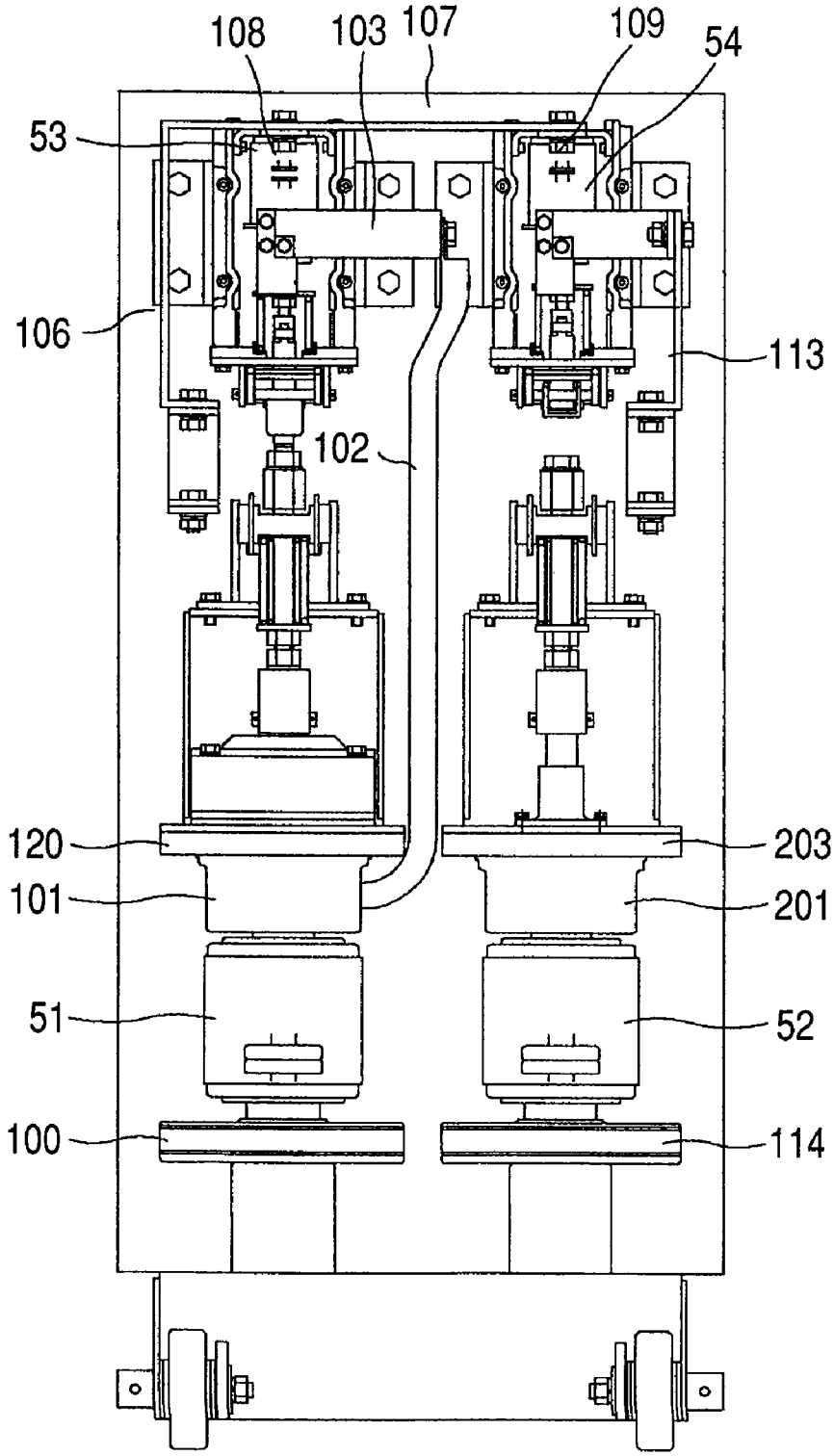
FIG. 2 is a back view of the commutation type DC circuit breaker shown in FIG. 1 according to the invention.
Figure 3:
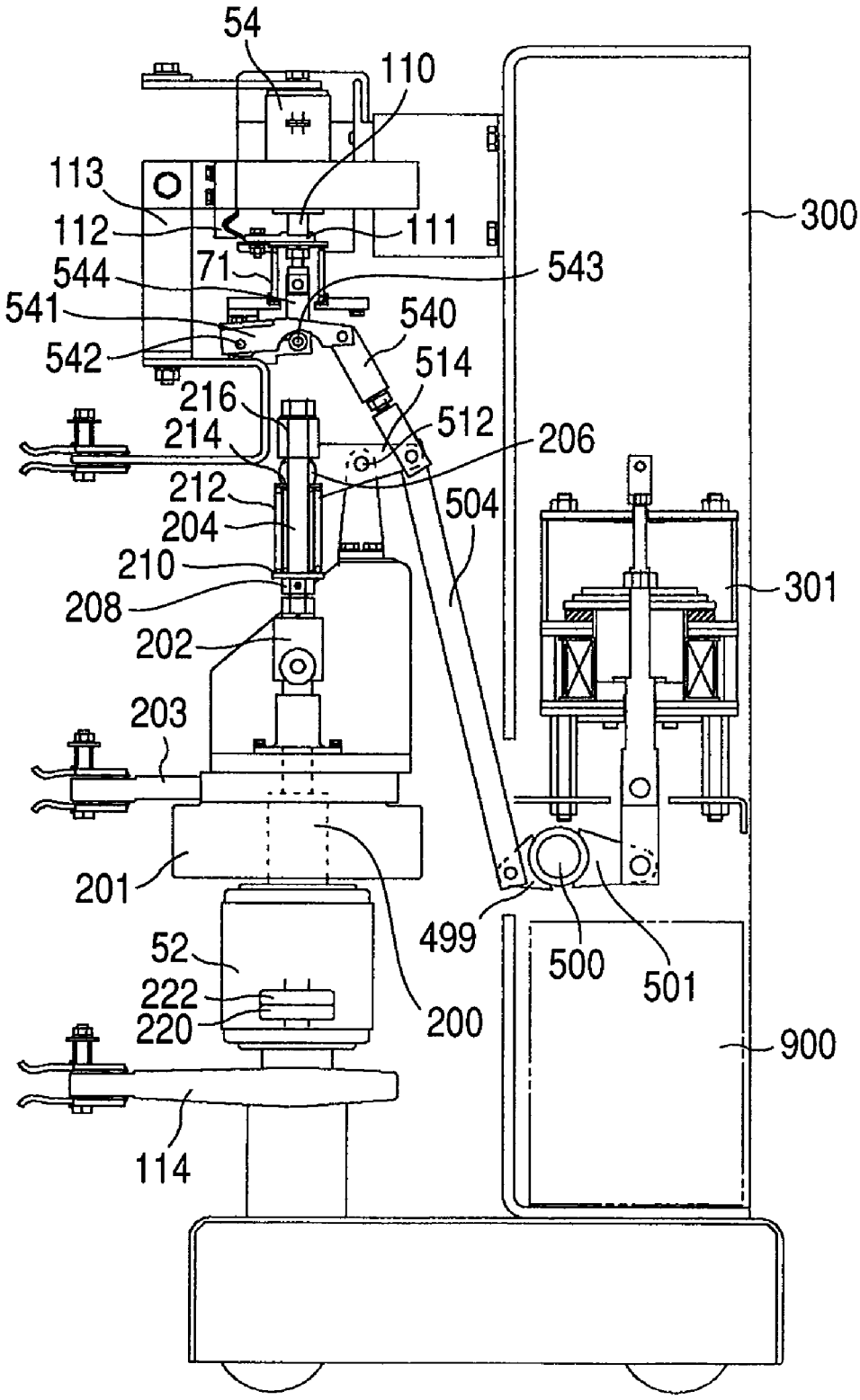
FIG. 3 is a right side view of the commutation type DC circuit breaker shown in FIG. 1 according to the invention.
Figure 4:
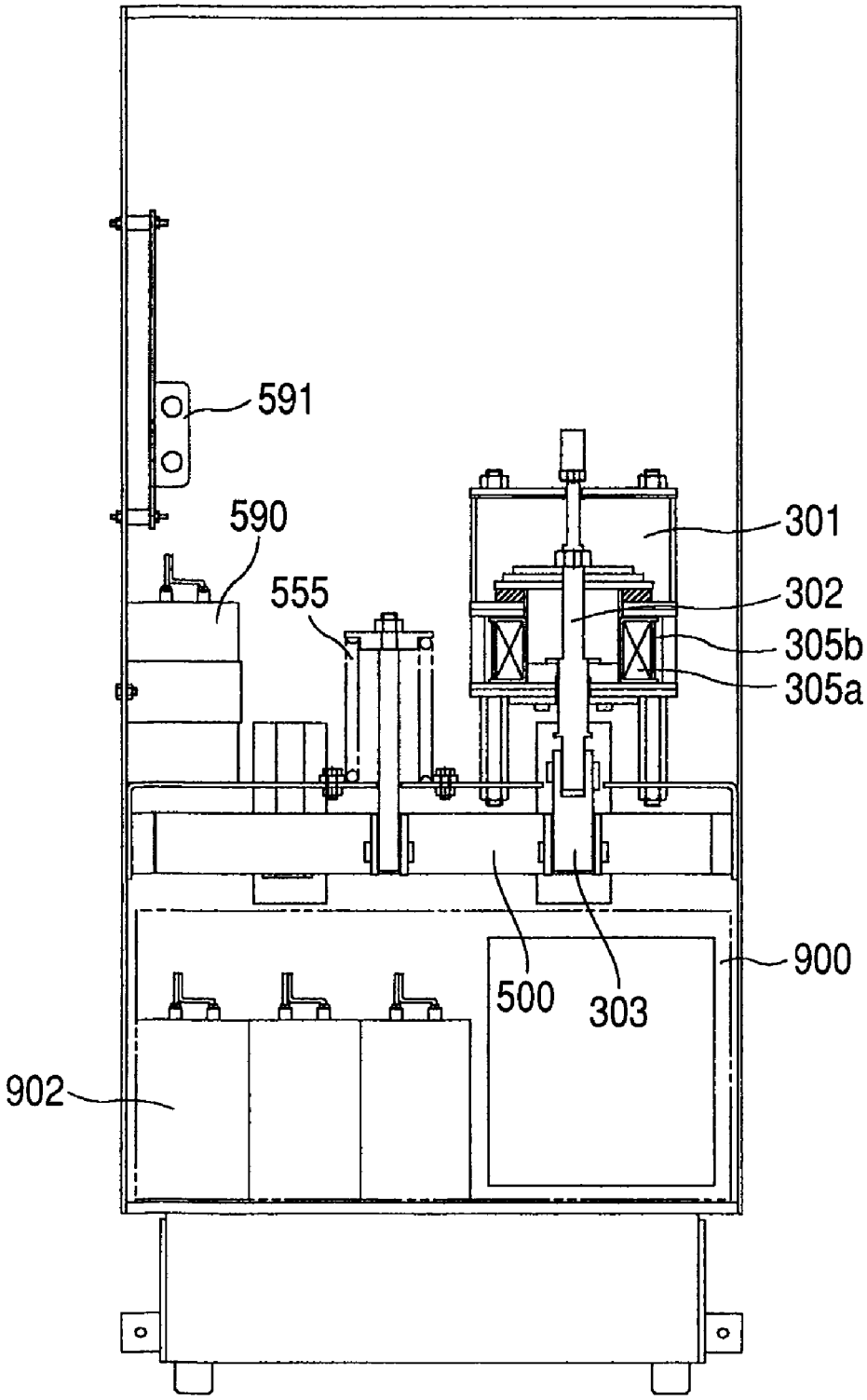
FIG. 4 is a front view of the commutation type DC circuit breaker shown in FIG. 1 according to the invention.
Figure 5:
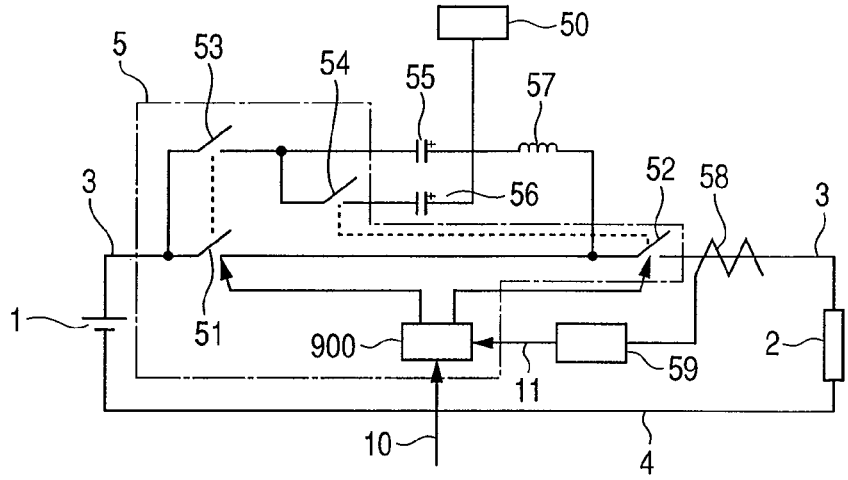
FIG. 5 is a system circuit diagram for the commutation type DC circuit breaker shown in FIG. 1 according to the invention.
Figure 6:
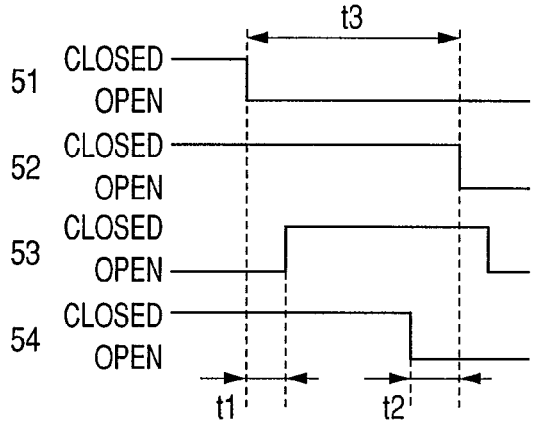
FIG. 6 is a time chart showing operation in case of an accident for the commutation type DC circuit breaker shown in FIG. 1 according to the invention.
Figure 7:
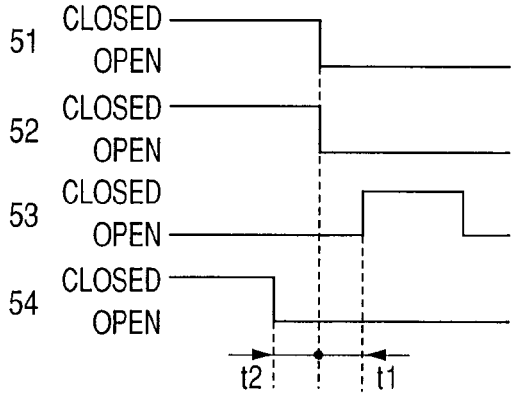
FIG. 7 is a time chart showing normal operation for the commutation type DC circuit breaker shown in FIG. 1 according to the invention.
Figure 14:
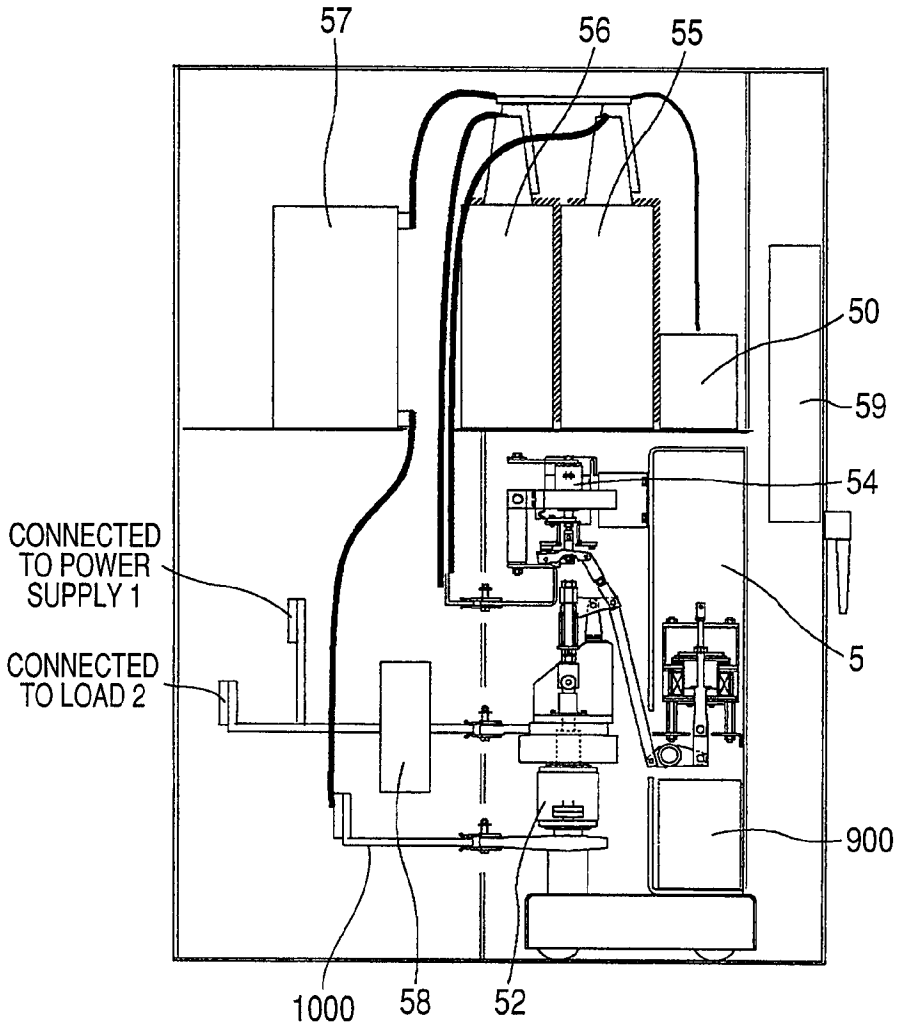
FIG. 14 is a left side sectional view of a switchgear incorporating the commutation type DC circuit breaker shown in FIG. 1 according to the invention.

FIGS. 1 to 7 and FIG. 14 show an embodiment of a commutation type DC circuit breaker as a circuit breaker according to the present invention, in which FIG. 1 is a left side sectional view of an embodiment of a commutation type DC circuit breaker as a circuit breaker according to the invention, FIG. 2 is a back view of an embodiment of the commutation type DC circuit breaker shown in FIG. 1 as a circuit breaker according to the present invention, FIG. 3 is a right side sectional view of an embodiment of the commutation type DC circuit breaker shown in FIG. 1 as a circuit breaker according to the present invention, FIG. 4 is a front view of an embodiment of the commutation type DC circuit breaker shown in FIG. 1 as a circuit breaker according to the present invention, FIG. 5 is a system circuit diagram of an embodiment of the commutation type DC circuit breaker shown in FIG. 1 as a circuit breaker according to the present invention, FIG. 6 is a time chart showing operation in case of an accident in an embodiment of the commutation type DC circuit breaker shown in FIG. 1 as a circuit breaker according to the present invention, and FIG. 7 is a time chart showing normal operation in an embodiment of the commutation type DC circuit breaker shown in FIG. 1 as a circuit breaker according to the present invention. FIG. 14 is a left side sectional view of switchgear which uses an embodiment of a commutation type DC circuit breaker as a circuit breaker according to the present invention.

First Embodiment

First, the method of use and the method of operation for an embodiment of a commutation type DC circuit breaker as a circuit breaker according to the present invention will be described referring to FIGS. 5 to 7.

In FIG. 5, reference numeral 1 represents a DC power supply which supplies 1500 V through its positive pole in an ordinary DC feeding circuit. Reference numeral 2 represents a load such as a train. Reference numeral 3 represents a feeding line which supplies electricity to the load and reference numeral 4 represents a flyback line which connects the load 2 and the DC power supply 1. The commutation type DC circuit breaker 5 as a circuit breaker according to the present invention is inserted midway in the feeding line 3 and switches electric power supplied from the DC power supply 1 to the load 2.

The commutation type DC circuit breaker 5 is comprised of four switches, a first main switch 51, a second main switch 52, a first sub switch 53 and a second sub switch 54, and a control unit 900. The commutation type DC circuit breaker 5 is connected with a first capacitor 55, a second capacitor 56 and a reactor 57. The first main switch 51 and the second main switch 52 are inserted into the feeding line 3 serially and are located near the DC power supply 1 and near the load 2 respectively. The series circuit composed of the first sub switch 53, first capacitor 55 and reactor 57 is connected in parallel with the main switch and the series circuit composed of the second sub switch 54 and second capacitor 56 is connected in parallel with the first capacitor 55.

A current transformer 58 in the feeding line 3 detects the current of the feeding line 3 and sends the current value to an overcurrent tripping device 59. The overcurrent tripping device 59 has a preset value for automatic interruption and outputs an opening command 11 when the current flowing through the feeding line 3 reaches the preset value. Upon receipt of an external command 10 or an opening command 11 from the overcurrent tripping device 59, the control unit 900 gives an opening/closing command to the commutation type DC circuit breaker 5.

The first sub switch 53, which operates in conjunction with the first main switch 51, once closes after opening of the first main switch 51 with time lag t1 (for example, 2 ms) and then opens. On the other hand, the second sub switch 54, which operates in conjunction with the second main switch 52, opens time t2 (for example, 2.5 ms) before opening of the second main switch 52.

For operation of the load 2, the first main switch 51 and second main switch 52 are closed to supply 1500 V DC to the load 2. At this time, the first sub switch 53 is open and the second sub switch 54 is closed. The first capacitor 55 and second capacitor 56 are charged to +2000 V with reference to the DC power supply 1.

If the load 2 is out of order or an earth fault occurs in the feeding line 3, a very large fast-rising fault current, which depends on circuit constants, flows in the feeding line 3. For example, if the circuit resistance is 15 mΩ and the circuit inductance is 150 pH, the maximum current attained is 100 kA and the maximum rush ratio is 10 kA/ms. If such a fault current occurs, the fault current must be interrupted quickly in order to minimize its influence on the equipment. First, the current transformer 58 detects the fault current value and sends it to the overcurrent tripping device 59. If the overcurrent tripping device 59 is preset, for example, to 12000 A for automatic interruption, when the fault current reaches 12000 A, it sends an opening command 11 to the control unit 900. According to a command from the control unit 900, the first main switch 51 opens. As the first main switch 51 opens, the first sub switch 53 closes with time lag t1. Consequently, an LC resonance circuit, which consists of the first capacitor 55, second capacitor 56, reactor 57, first main switch 51, first sub switch 53 and second sub switch 54, is established and the first capacitor 55 and second capacitor 56 previously charged by a charger 50 discharge electricity and a commutation current whose direction is reverse to the fault current direction is injected into the first main switch 51. Assuming that the capacitance of the first capacitor 55 is 600 μF and the capacitance of the second capacitor 56 is 1200 μF, the maximum reverse commutation current value is 40 kA, which means that if the first sub switch 53 is closed before the fault current reaches 40 kA, the fault current is offset by the commutation current. At the time when the current passing through the first main switch 51 becomes zero, the main switch 51 finishes interruption. After the first main switch 51 opens, the second main switch 52 opens with time lag t3; if time t3 is set so as to satisfy the relation of t3>t1+t2, the second sub switch 54 does not open before the first sub switch 53 closes and thus the first capacitor 55 and second capacitor 56 discharge electricity simultaneously, making it possible to deal with a large current as mentioned above. Even when the first main switch 51 has finished interruption, there is a period in which the first sub switch 53 and second sub switch 54 are both closed and thus the first capacitor 55 and second capacitor 56 are charged by the DC power supply 1. This charge current is interrupted when the charge voltage rises and the circuit current becomes almost zero or below the vacuum valve chopping current.

On the other hand, interruption by the commutation type DC circuit breaker 5 in normal operation is done according to an external command 10. Upon receipt of an opening command as an external command 10, the first main switch 51 and second main switch 52 open simultaneously. At this time, since the second sub switch 54 opens time t2 before the second main switch 52 opens, an LC resonance circuit, which consists of the first capacitor 55, reactor 57, first main switch 51 and first sub switch 53, is established when the first sub switch 53 closes.

Out of the previously charged first capacitor 55 and second capacitor 56, only the first capacitor 55 discharges electricity and a commutation current whose direction is reverse to the load current direction is injected into the first main switch 51. Here, the maximum value of the load current is below the value preset on the overcurrent tripping device 59, 12000 A. If the maximum commutation current is 14 kA when only the first capacitor 55 discharges electricity, the maximum load current of 12000 A is offset and when the current of the first main switch 51 becomes zero, the first main switch 51 finishes interruption. After the breaker opens, the second main switch 52 performs the function to disconnect the load 2 and the first capacitor 55, and the load 2 and the second capacitor 56 to prevent an electric shock accident due to the capacitor charge voltage in the load circuit.

Next, an embodiment of the above commutation type DC circuit breaker 5 as a circuit breaker according to the present invention will be described referring to FIGS. 1 to 4 and FIG. 14.

In an embodiment of the commutation type DC circuit breaker as a circuit breaker according to the present invention, the four switches are automatically activated at the above timings by two electromagnets and a mechanical link structure. FIGS. 1 to 4 indicate that the circuit is in operation (the first main switch 51 and second switch 52 are closed). All the four switches are illustrated here as vacuum valves incorporating a pair of contacts but may be air switches or the like.

First, electrical connection in an embodiment of the commutation type DC circuit breaker 5 as a circuit breaker according to the present invention will be described.

A fixed feeder 100 of the first main switch 51 and a fixed feeder 114 of the second main switch 52 are connected to a bus bar 1000 (FIG. 14) located outside the commutation type DC circuit breaker 5. One end of the bus bar 1000 is connected with the reactor 57. The other end of the reactor 57 is connected with the first capacitor 55 and second capacitor 56. A movable conductor 62 of the first main switch 51 is electrically conductive to a movable feeder 120 through a power collector 101. The movable feeder 120 is connected with the DC power supply 1. The movable conductor 62 of the first main switch 51 and the movable conductor 69 of the first sub switch 53 are constantly connected electrically through conductors 102, 103, a flexible conductor 104 and a conductor 105.

A feeder 106 and a feeder 107 are fixed on a fixed conductor 108 of the first sub switch 53. The feeder 107 is connected with a fixed conductor 109 of the second sub switch 54. On the other hand, the feeder 106 is connected with the first capacitor 55 outside the commutation type DC circuit breaker 5. A movable conductor 110 of the second sub switch 54 is connected with the second capacitor 56 through a conductor 111, a flexible conductor 112 and a feeder 113. A movable conductor 200 of the second main switch 52 is electrically conductive to a movable feeder 203 through a power collector 201. The movable feeder 203 is connected with the load 2. The system circuit shown in FIG. 5 is implemented by the above electrical connections.

Next, the mechanical structure of an embodiment of the commutation type DC circuit breaker 5 as a circuit breaker according to the present invention will be described referring to FIGS. 1 to 4.

As shown in FIG. 1, the movable conductor 62 of the first main switch 51 is pin-connected with a member 64. One end of an operating rod 65 is fixed on the member 64 and the other end is fixed on a hinge 66. The movable conductor 69 of the first sub switch 53 is connected with the hinge 66 through a member 67 by a pin 534. In other words, the movable conductor 62 of the first main switch 51 and the movable conductor 69 of the first sub switch 53 work in conjunction with each other. The operating rod 65A penetrates a pin 150 whose top and bottom are flattened. A washer 153, a contact pressure spring 151 and a washer 154 are held between the pin 150 and a nut 152 fixed on the operating rod 65.

Also the operating rod 65 penetrates an electromagnetic repulsion coil 170 that constitutes an opening means, and a repulsion plate 171. An eddy current is generated in the repulsion plate 171 by excitation of the electromagnetic repulsion coil 170, and an electromagnetic repulsive force between the current of the electromagnetic repulsion coil 170 and the eddy current of the repulsion plate 171 is received by the member 64 through the repulsion plate 171 and the operating rod 65 moves upward in FIG. 1 by the repulsive force.

As shown in FIG. 3, the movable conductor 200 of the second main switch 52 is pin-connected with a member 202. One end of an operating rod 204 is fixed on the member 202. The operating rod 204 penetrates a pin 206 with flattened abutment surfaces at the top and bottom. A washer 210, a contact pressure spring 212 and a washer 214 are held between the pin 206 and a nut 208 fixed on the operating rod 202. With the second main switch 52 open, the hexagonal part 216 at the top of the operating rod 202 is engaged with the pin 206 by a contact pressure spring 212. On the other hand, in closing operation of the second main switch 52, the pin 206 and hexagonal part 216 are disengaged at the moment the fixed contact 220 and movable contact 222 of the second main switch 52 contact each other, and as the contact pressure spring 212 is compressed, the load of the contact pressure spring 212 becomes a contact force of the contacts in the second main switch 52.

As shown in FIGS. 1 and 3, the operating rod 65 of the first main switch 51 and the operating rod 202 of the second main switch 52 are driven by an electromagnet 301 located beside the first main switch 51 and second main switch 52 in an operating device case 300. The shaft 302 of the electromagnet 301 is coupled with one lever 501 of a main shaft 500 through a member 303. The other levers 503 and 499 of the main shaft 500 are coupled with an insulating rod 502 extending toward the first main switch 51 and an insulating rod 504 extending toward the second main switch 52 respectively. The insulating rod 502 is engaged with the pin 150 through a sub shaft 510 and the insulating rod 504 is engaged with the pin 206 through a sub shaft 512. In other words, as shown in FIGS. 1 and 3, the attractive force of the electromagnet 301 is transmitted to the operating rod 65 of the first main switch 51 and the operating rod 204 of the second main switch 52 through the main shaft 500, levers 501, 503, 499 provided on it and the sub shafts 510, 512 and levers 513, 514 provided on them. The first main switch 51 or the second main switch 52 is turned on (closed) by exciting a first coil 305*a* in the electromagnet 301 and moving a plunger 304 downward in the figure.

The first sub switch 53 is driven in conjunction with the first main switch 51 as mentioned above; however, in order to achieve operation timings as illustrated in FIGS. 6 and 7, a coupling member 530 and a lever 531 are provided as shown in FIG. 1. The coupling member 530 and lever 531 are connected with each other by a pin 533. The other end of the coupling member 530 is connected with the lever 513 of the sub shaft 510. On the other hand, the lever 531 freely rotates around a shaft 532 as a fulcrum.

When the first main switch 51 opens, the operating rod 65 moves upward in FIG. 1 and the first sub switch 53 once closes and at the same time the lever 531 rotates counterclockwise, which causes the lever 531 to engage with the pin 534 in the hinge 66 and moves back the movable conductor 69 of the first sub switch 53 toward the opening direction (downward). The hole in the hinge 66 through which the pin 534 penetrates is made oval in order to enable the movable conductor 69 to move toward the opening direction (downward) regardless of the position of the operating rod 65. Reference numeral 70 represents a spring which gives a contact force to the first sub switch 53.

As shown in FIG. 3, a coupling member 540 and a lever 541 are also provided on the second sub switch 54. When the second main switch 52 opens, the lever 541 rotates around the shaft 542 clockwise, which causes the lever 541 to engage with a pin 543 in a member 544 coupled with the movable conductor 110 of the second sub switch 54 and moves back the movable conductor 110 toward the opening direction (downward). Reference numeral 71 represents a spring which gives a contact force to the second sub switch 54. The coupling members 530 and 540 are variable in length and used to adjust opening and closing timings for the main switches and sub switches.

In FIG. 4, reference numeral 555 represents a tripping spring which is provided in the operating device case 300 so as to work in conjunction with the main shaft 500; reference numeral 590 represents a capacitor which supplies exciting energy to the first coil 305*a*; and reference numeral 591 represents a control circuit for the electromagnet 301. The area indicated by chain double-dashed line represents the control unit 900 for supplying exciting energy to the electromagnetic repulsion coil 170, which is comprised of a capacitor 902 and a control board 903.

Next, the structure of the electromagnet 301 will be described. The first coil 305*a* and second coil 305*b* are provided on a bobbin 901. Fixed cores 903, 904, 905 are provided on the upper, outer circumferential and lower surfaces of the first coil 305*a* and second coil 305*b* and a permanent magnet 306 rests on the fixed core 903 on the upper surface. The movable core of the electromagnet 301 is composed of a movable circular plate 906 and the plunger 304 and held between the shaft 302 and a nut 907. When the electromagnet 301 is turned on, the plunger 304 and a center leg 908 are in contact with each other.

Next, operation of an embodiment of the commutation type DC circuit breaker 5 as a circuit breaker according to the present invention will be described.

(Normal Closing Operation and Opening Operation)

In closing operation, the first coil 305*a* of the electromagnet 301 is excited to let the plunger generate an attractive force. This attractive force is transmitted to the operating rod 65 of the first main switch 51 and the operating rod 204 of the second main switch 52 through the main shaft 500 and sub shafts 510, 512, so that the movable conductors 62 and 200 move downward and the first main switch 51 and second main switch 52 close. In closing operation, the contact pressure springs 151, 212 of the main switches 51, 52 and the tripping spring 555 in the operating device case 300 are elastically charged to prepare for opening of the first main switch 51 and second main switch 52.

At this time, the first sub switch 53 becomes open as the pin 534 and hinge 66 are engaged, and the second sub switch 54 becomes closed as the lever 541 and pin 543 are disengaged. Upon completion of closing operation, the electromagnet 301 is de-excited. The reactive forces of the elastically charged contact pressure springs 151, 212 and tripping spring 555 are held by the attractive force of the permanent magnet 306 in the electromagnet 301. At this time, a magnetic flux from the permanent magnet 306 is generated primarily in the route from the permanent magnet 306 through the movable plate 906, plunger 304, center leg 908, fixed core 905, fixed core 904 and fixed core 903 to the permanent magnet 306.

In normal opening operation of the first main switch 51 and second main switch 52, the first coil 305*a* is excited in a direction reverse to the excitation direction in the above closing operation. By reversely exciting the first coil 305*a*, the magnetic flux between the plunger 304 and center leg 908 is cancelled and the attractive force of the electromagnet 301 is decreased. When the attractive force becomes smaller than the spring reactive force, the first main switch 51 and second main switch 52 start opening operation. In this electromagnetic operating mechanism, opening operation is basically done by the spring forces of the contact pressure springs 151, 212 and tripping spring 555. In other words, reverse excitation of the first coil 305*a* only requires an energy enough to cancel the magnetic flux generated by the permanent magnet.

(Quick Interruption in Case of an Accident)

In quick interruption in case of an accident, the electromagnetic repulsion coil 170 is excited to generate an electromagnetic repulsive force from the repulsion plate 171. The member 64 receives the electromagnetic repulsive force and the operating rod 65 coupled with the member 64 moves upward further flexing the contact pressure spring 151 until the first main switch 51 becomes open and the first sub switch 53 becomes closed. At this time, the main shaft 500 and sub shaft 510 are not activated and the second main switch 52 and second sub switch 54 remain unchanged.

The second coil 305*b* of the electromagnet 301 is connected in series with the electromagnetic repulsion coil 170 and excited simultaneously with the electromagnetic repulsion coil 170. When the direction of excitation of the second coil 305*b* is set to be the same as the direction of excitation of the first coil 305*a* in opening operation (reverse excitation), the magnetic flux of the permanent magnet 306 is cancelled and the attractive force of the electromagnet 301 is thus decreased. When the attractive force of the electromagnet 301 becomes smaller than the reactive forces of the contact pressure springs 151, 212 and tripping spring 555, the plunger 304 moves upward. In response, the second main switch 52 and second sub switch open as well.

Figure 8:
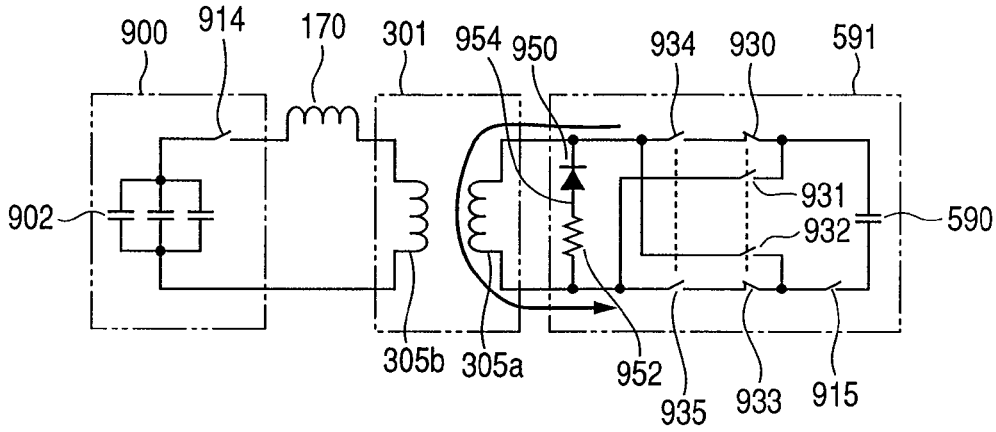
FIG. 8 is a diagram illustrating a coil excitation method in closing operation for the commutation type DC circuit breaker shown in FIG. 1 according to the invention.
Figure 9:
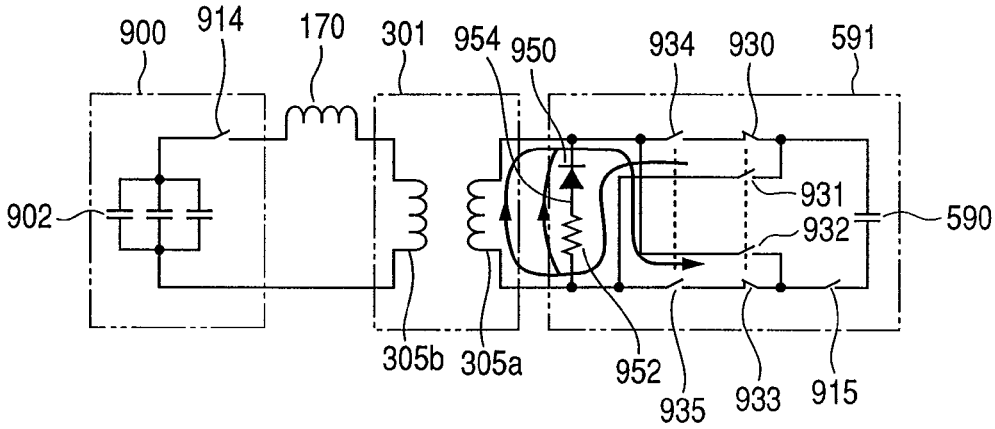
FIG. 9 is a diagram illustrating a coil excitation method in opening operation for the commutation type DC circuit breaker shown in FIG. 1 according to the invention.
Figure 10:
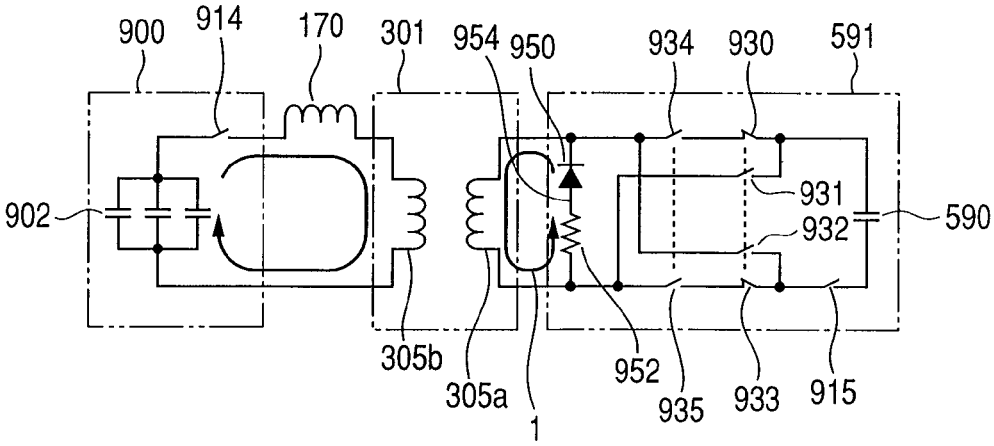
FIG. 10 is a diagram illustrating a coil excitation method in quick interruption for the commutation type DC circuit breaker shown in FIG. 1 according to the invention.

Next, the control method of an embodiment of the commutation type DC circuit breaker as a circuit breaker according to the present invention will be described referring to FIGS. 8 to 10. FIGS. 8, 9 and 10 are diagrams which explain operation of the control circuit in closing operation, normal opening operation and interruption in case of an accident, respectively. Normal closing operation and opening operation are controlled by the control board 591. In closing operation, two contacts 934, 935 are turned ON to make a circuit and the switch 915 is turned ON to give the charge of the capacitor 590 to the first coil 305*a* in the electromagnet 301 (FIG. 8). On the other hand, in normal opening operation, four contacts 930, 931, 932, 933 are activated to make a circuit and the switch 915 is turned ON to excite the first coil 305*a* in a direction reverse to the excitation direction in closing operation (FIG. 9). The arrowed curves in FIGS. 8 and 9 express the directions of exciting current flows.

In quick interruption in case of an accident, the switch 914 is turned ON to excite the electromagnetic repulsion coil 170 and the second coil 305*b* in the electromagnet 201 by the charge of the capacitor 902 located in the control unit 900 (FIG. 10).

Since the first coil 305*a* and second coil b constitute a duplex winding structure, when one of them is excited, an induced voltage is generated in the other (electromagnetic induction). For the second coil 305*b*, which is used for quick interruption, the inductance must be small because of high speed and the number of turns is 10 (turns) or so. On the other hand, for the first coil 305*a*, which is used for normal opening or closing operation, the coil current must be decreased in order to reduce the burdens on the capacitor 590 and switch 915 and the number of turns is set to 200-400 turns. Since the induced voltage is proportional to the number of turns, the voltage induced in the second coil upon excitation of the first coil does not pose a problem (in normal closing or opening operation) but conversely, or in quick interruption, a voltage on the kilovolt-order is induced in the first coil 305*a*.

In this embodiment, a surge voltage suppressor 954 is provided as a countermeasure against induced voltage in the first coil 305*a*. The surge voltage suppressor 954 is located in parallel with the first coil 305*a* so that a circulating current flows between the first coil 305*a* and the surge voltage suppressor 954. A zinc oxide varistor (ZNR) may be used for the surge voltage suppressor 954 but in consideration of durability to withstand frequent operation, it is desirable that it be comprised of a protective resistance 952 and a diode 950 as shown in FIGS. 8 to 10. As shown in FIG. 10, in quick interruption, induced current I flows through the surge voltage suppressor 954 and therefore the induced voltage in the first coil 305*a* is decreased. When the protective resistance 952 is decreased, the induced voltage is decreased but the electromagnet 301 is released for a longer time. In order to meet the circuit insulation requirement, the resistance should be as large as possible.

In this embodiment, more operating energy is required in closing operation in which the contact pressure springs 151, 212 and tripping spring 555 are elastically charged for driving, than in opening operation which basically uses the above spring forces. As explained earlier, in the case of the electromagnet 301 in this embodiment, for opening operation it is enough to cancel the magnetic flux of the permanent magnet 306 in the electromagnet 301. For this reason, the diode 950 is disposed as shown in FIGS. 8 to 10 so as not to affect closing operation, which requires a large energy. On the other hand, for normal opening operation, which uses a small operating energy, the current may be distributed to the surge voltage suppressor 954. In other words, this surge voltage suppressor 954 may be said to be particularly effective for the electromagnet 301 in this embodiment, for which the opening operation energy is small.

Furthermore, this control method adopts the following ingenious approach. If an earth fault accident occurs just after the commutation type DC circuit breaker 5 is turned on, opening operation must be immediately started (trip-free operation). Unlike an AC system in which a current zero point always exists, in a DC system, if the fault current exceeds the commutation current due to delay in opening operation, interruption might fail.

In closing operation, if an earth fault accident occurs upon contact of the contacts of the first main switch 51 and second main switch 52, the current transformer 58 in the feeding line 3 detects the fault current and sends an opening/closing command to the commutation type DC circuit breaker 5 through the overcurrent tripping device 59 and the control unit 900. At this moment, the control circuit is as shown in FIG. 8 because closing operation is under way in the commutation type DC circuit breaker 5. If the electromagnetic repulsion coil 170 and second coil 305*b* are excited in this condition, an excessive induced current would flow in the low-impedance circuit (first coil 305*a*-contact 935-contact 933-switch 915-capacitor 590-contact 930-contact 934-first coil 305*a*), which might cause a delay in opening time and damage to the switch 915. Hence, in the control method in this embodiment, at the same time when the electromagnetic repulsion coil 170 is excited, the switch 915 is forced to turn OFF to break the low-impedance circuit. Therefore, the switch 914 and switch 915 must provide quick response and particularly the switch 915 must demonstrate a quick interruption performance. In order to meet the above requirement, a thyristor is used for the switch 914 and an FET or IGBT semiconductor switch is used for the switch 915.

Next, the advantage of an embodiment of the commutation type DC circuit breaker 5 as a circuit breaker according to the present invention will be described.

The conventional circuit breaker includes a vacuum valve, an operating mechanism provided in the vacuum valve opening/closing direction, and an electromagnetic repulsion driving mechanism provided midway in the operating mechanism where a permanent magnet is installed in the operating mechanism and the closed state is held by the attractive force of the permanent magnet. In quick interruption, it is necessary to give the movable part of the electromagnet 301 an electromagnetic repulsive force which exceeds the result of subtraction of the reactive forces of the contact pressure springs 151, 212 and tripping spring 555 from the attractive force of the permanent magnet 306, namely the surplus force to hold the closed state of the vacuum valve. In this type of circuit breaker, since for quick interruption it is necessary to not only achieve a prescribed opening speed but also provide an electromagnetic repulsive force in excess of the attractive force of the permanent magnet to hold the closed state, a large electromagnetic repulsion driving mechanism and a larger power supply capacity are needed. Also, a mechanism to reduce rebound of the movable electrode shaft due to the electromagnetic repulsion reactive force must be separately provided to prevent reclosing.

In this embodiment, the electromagnet 301 is reversely excited simultaneously with electromagnetic repulsion operation to release the attractive force of the permanent magnet 306 and facilitate quick interruption. As a consequence, a reliable circuit breaker which reduces rebound of the movable electrode shaft and prevents reclosing is provided. Apart from the first coil 305*a* intended for normal closing/opening operation, a second coil 305*b* with a small inductance which assures quick response is provided and connected in series with the electromagnetic repulsion coil 170 for simultaneous excitation.

In the case of the electromagnet 301 in this embodiment, opening operation, which basically relies on the accumulated elastic forces of the contact pressure springs 151, 212 and tripping spring 555, is performed simply by canceling the magnetic flux of the permanent magnet 306 to give an attractive force, which is advantageous in assuring quick response.

Since the first coil 305*a* and second coil 305*b* constitute a duplex structure, when one of them is excited, an induced voltage is generated in the other coil. Although an induced voltage generated in the first coil 301*a*, which has a larger number of turns, may be a problem for quick interruption in which magnetic flux variation is large, it is solved by the surge voltage suppressor 954 provided in parallel with the coil. The surge voltage suppressor 954, composed of a protective resistance 952 and a diode 950, assures durability to withstand frequent operation. When the surge voltage suppressor 954 is composed of a protective resistance 952 and a diode 950, the diode 950 is arranged as follows. During opening operation which only requires a small operating energy, the exciting current is allowed to be distributed to the surge voltage suppressor 954, and during closing operation which requires a larger operating energy, such current distribution is not allowed. This surge voltage suppressor 954 cannot be applied to an electromagnet which requires a large operating energy for both closing operation and opening operation. It is useful for a case that the accumulated elastic energies of the contact pressure springs 151, 212 and tripping spring 555 are used for opening operation as in this embodiment.

In order to achieve quick interruption (trip-free duty) after closing operation, at the same time when the switch 914 to excite the electromagnetic repulsion coil 170 is turned ON, the switch 915 to excite the first coil 302*a* is turned OFF. A thyristor is used for the switch 914 and an FET or IGBT semiconductor switch is used for the switch 915 to assure quick switch response and particularly assure quick interruption performance of the switch 915.

Second Embodiment

Figure 12:
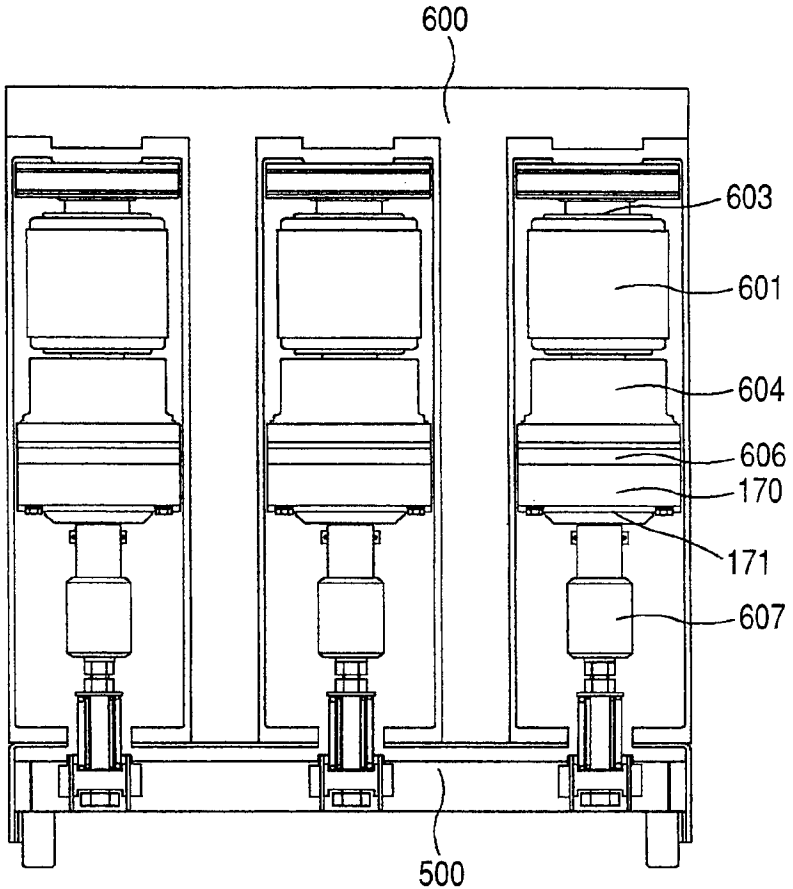
FIG. 12 is a back view of the three-phase high speed circuit breaker shown in FIG. 11 according to the invention.
Figure 11:
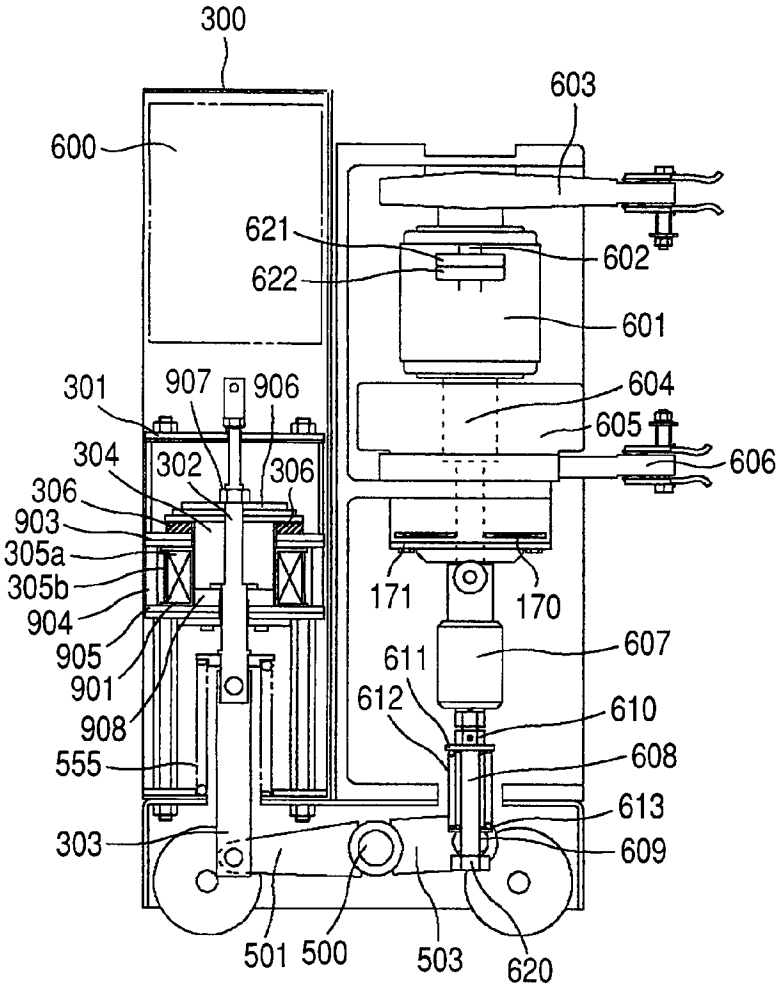
FIG. 11 is a right side sectional view of a three-phase high speed circuit breaker as a circuit breaker according to the invention.
Figure 13:
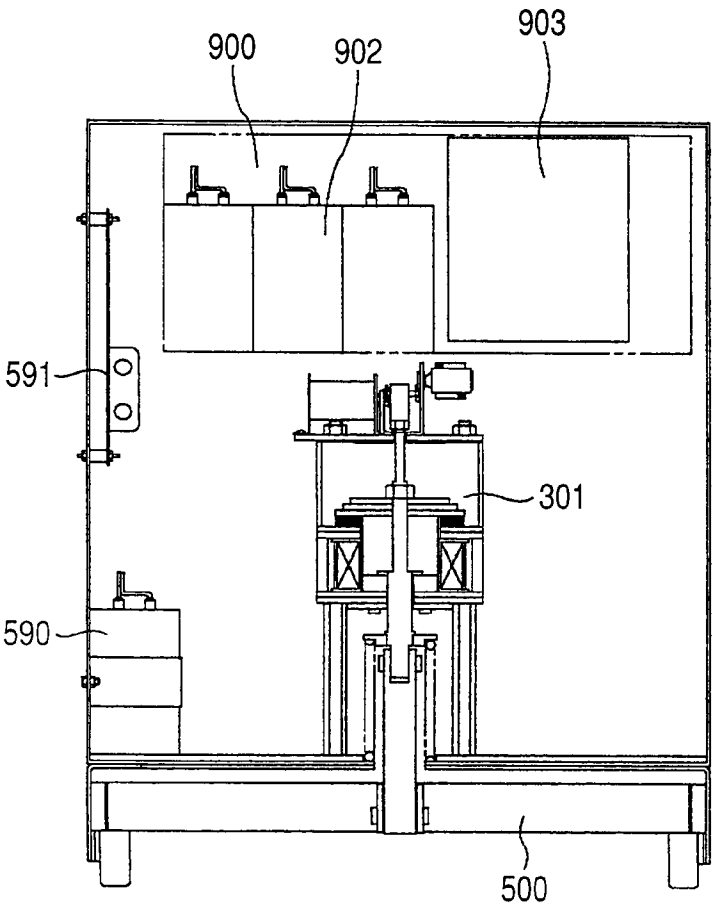
FIG. 13 is a front view of the three-phase high speed circuit breaker shown in FIG. 11 according to the invention.

FIGS. 11 to 13 show an embodiment of a three-phase high speed circuit breaker 600 as a circuit breaker according to the present invention, in which FIG. 11 is a right side sectional view of the three-phase high speed circuit breaker 600 as a circuit breaker according to the present invention, FIG. 12 is a back view thereof, and FIG. 13 is a front view thereof, all indicating the closed state. In these figures, the parts designated by the same reference numerals as in FIGS. 1 to 4 are the same parts.

In these figures, the three-phase high speed circuit breaker 600 includes a vacuum valve 601 incorporating a freely releasable contact. A fixed conductor 602 of a fixed electrode of the vacuum valve 601 is connected with a fixed feeder 603 located on the upper side. On the other hand, a movable conductor 604 of its movable electrode is electrically conductive to a movable feeder 606 through a power collector 605.

The movable conductor 604 is coupled with one end of an insulating rod 607. The other end of the insulating rod 607 is fixed on an operating rod 608. The operating rod 608 penetrates a pin 609 with flattened abutment surfaces at the top and bottom. The pins 609 for three phases are all engaged with one lever 503 of a single main shaft 500. A washer 611, a contact pressure spring 612 and a washer 613 are held between the pin 609 and a nut 610 fixed on the operating rod 608. With the vacuum valve 601 open, the hexagonal part 620 at the bottom of the operating rod 608 is engaged with the pin 609 by a contact pressure spring 612. On the other hand, in closing operation of the vacuum valve 601, the pin 609 and hexagonal part 620 are disengaged at the moment the fixed contact 621 and movable contact 622 of the vacuum valve 601 contact each other, and the load of the contact pressure spring 612 becomes a contact force of the contacts.

The operating rod 608 is communicated with an electromagnetic repulsion coil 170 and a repulsion plate 171 which constitute an opening means. As in the foregoing embodiment, an electromagnetic repulsive force generated in the repulsion plate 171 by excitation of the electromagnetic repulsion coil 170 is received by an insulating rod 607 and due to the repulsive force, an operating rod 608 moves downward in the figure.

The operating rod 608 is driven by an electromagnet 301 located beside the vacuum valve 601 in an operating device case 300. The shaft 302 of the electromagnet 301 is coupled with the other lever 501 of the main shaft 500 through a member 303. In other words, the attractive force of the electromagnet 301 is transmitted to the operating rod 608 through the main shaft 500. The vacuum valve 601 is turned on by exciting a first coil 305*a* in the electromagnet 301 and moving a plunger 304 downward in the figure.

The structure of the electromagnet 301 is the same as that of the foregoing embodiment. The first coil 305*a* and second coil 305*b* are provided on a bobbin 901 and fixed cores 903, 904, 905 are provided on the upper, outer circumferential and lower surfaces of the first coil 305*a* and second coil 305*b* and a permanent magnet 306 rests on the fixed core 903 on the upper surface. The movable core of the electromagnet 301 is composed of a movable circular plate 906 and a plunger 304 and held between the shaft 302 and a nut 907. When the electromagnet 301 is turned on, the plunger 304 and a center leg 908 are in contact with each other.

Next, operation of an embodiment of the above three-phase high speed circuit breaker 600 as a circuit breaker according to the present invention will be described.

In closing operation, the first coil 305*a* of the electromagnet 301 is excited by a precharged capacitor 590 as shown in FIG. 13 to let the plunger generate an attractive force. This attractive force is transmitted to the operating rod 608 through the main shaft 500, so that the movable conductor 604 moves upward and the vacuum valve 601 closes. Simultaneously with closing operation, the contact pressure spring 612 and the tripping spring 555 are elastically charged to prepare for opening operation. Upon completion of closing operation, the electromagnet 301 is de-excited. The reactive forces of the elastically charged contact pressure spring 612 and tripping spring 555 are held by the attractive force of the permanent magnet 306 in the electromagnet 301.

In normal opening operation of the vacuum valve 601, the first coil 305*a* is excited in a direction reverse to the excitation direction in closing operation. By reversely exciting the first coil 305*a*, the magnetic flux generated by the permanent magnet 306 is cancelled and when the attractive force of the electromagnet 301 becomes smaller than the spring reactive force, the vacuum valve 601 start opening operation.

The second coil 305*b* of the electromagnet 301 is connected in series with an electromagnetic repulsion coil 170. In quick interruption in case of an accident, the electromagnetic repulsion coil is excited by a control unit 900 (FIG. 13) comprised of a capacitor 902 and a control board 903. By the electromagnetic repulsive force generated in the repulsion plate 171, the operating rod 608 moves downward further flexing the contract pressure spring 612 until the vacuum switch 601 becomes open. At this time, the main shaft 500 does not move yet.

In quick interruption, the electromagnetic repulsion coil 170 and the second coil 305*b* of the electromagnet 301 are simultaneously excited. When the direction of excitation of the second coil 305*b* is set to be the same as the direction of excitation of the first coil 305*a* in normal opening operation (reverse excitation), the attractive force of the permanent magnet 306 is decreased. When the sum of loads of the contact pressure spring 612 and tripping spring 555 exceeds the attractive force of the permanent magnet 306, the plunger 304 begins to move upward. In response, the whole operating mechanism of the high speed circuit breaker 600 enters the open state. The control method of the high speed circuit breaker 600 is the same as in the foregoing embodiment and as illustrated in FIGS. 8 to 10.

In quick interruption by the vacuum valve 601, it is necessary to give the movable part of the electromagnet 301 an electromagnetic repulsive force which exceeds the result of subtraction of the reactive forces of the contact pressure spring 612 and tripping spring 555 from the attractive force of the permanent magnet 306, namely the surplus force to hold the closed state of the vacuum valve 601. If the electromagnetic repulsive force is directly given to the electromagnet movable part, the reactive force incurs the risk of contact reclosing, which means that a mechanism to reduce rebound must be separately provided as in the prior art. In this embodiment, the electromagnet 301 is reversely excited simultaneously with electromagnetic repulsion operation to release the attractive force of the permanent magnet 306, which suppresses rebound of the movable electrode shaft in the course of current interruption by the electromagnetic repulsion driving mechanism, making it possible to provide a reliable circuit breaker.

What is claimed is:

1. A circuit breaker comprising:

a vacuum valve having a movable contact connected to an operating mechanism via a movable conductor, which is connected to an operating rod;

an electromagnetic repulsion coil coaxially disposed around an axis of the movable conductor and the operating rod; and an electromagnet comprising a first coil for driving an operating shaft of the vacuum valve in an opening direction by an electromagnetic repulsion, a second coil connected to the electromagnetic repulsion coil and a movable iron core, a fixed core, and a permanent magnet, wherein the operating mechanism closes the vacuum valve when the first coil is excited, and holds the vacuum valve in a closed position by an attractive force of the permanent magnet, and wherein in a case of power failure, the second coil is excited in a direction opposite to a magnetic field formed by the first coil at the time of opening of the vacuum valve to open the vacuum valve within several milliseconds and the electromagnetic repulsion coil is excited simultaneously with the second coil.

2. The circuit breaker as described in claim 1, wherein the electromagnetic repulsion coil and the second coil are connected in series.

3. The circuit breaker as described in claim 1, wherein the first coil and the second coil are provided on a single bobbin and number of turns of the first coil is larger than a number of turns of the second coil.

4. The circuit breaker as described in claim 1, wherein a switch to excite the electromagnetic repulsion coil is constituted by a thyristor and FET or IGBT is used for a switch to excite the first coil.

5. The circuit breaker as described in claim 1, wherein a surge voltage suppressor comprised of a zinc oxide varistor or a diode and a resistance is connected in parallel with the first coil.

6. The circuit breaker according to claim 1, further comprising a condenser for injecting charges, in the case of power failure, in a direction reverse to a direction of a line current of the vacuum valve.

7. The circuit breaker according to claim 1, wherein the vacuum circuit breaker is a direct current circuit breaker.

8. The circuit breaker according to claim 1, wherein the vacuum circuit breaker is a high speed circuit breaker.

9. The circuit breaker according to claim 1, wherein the vacuum valve comprises a first main switch, a second main switch and a first sub-switch.

10. The circuit breaker according to claim 1, wherein an electromagnetic repulsion from the excited electromagnetic repulsion coil is applied to an electromagnetic repulsion plate disposed to generate an eddy current therein to impart the electromagnetic repulsion to a member to drive the operating rod upwardly.

* * * * *